US007148773B2

(12) United States Patent
Lohr

(10) Patent No.: US 7,148,773 B2
(45) Date of Patent: Dec. 12, 2006

(54) DEVICE FOR CARRYING OUT THE NON-CONTACT ROTATIONAL TRANSMISSION OF HIGH-FREQUENCY SIGNALS

(75) Inventor: Georg Lohr, Eichenau (DE)

(73) Assignee: Schleifring und Apparatebau GmbH, Fuerstenfeldbruck (DE)

( * ) Notice: Subject to any disclaimer, the term of this patent is extended or adjusted under 35 U.S.C. 154(b) by 0 days.

(21) Appl. No.: 10/332,081

(22) PCT Filed: Aug. 2, 2001

(86) PCT No.: PCT/DE01/02894

§ 371 (c)(1),
(2), (4) Date: Sep. 23, 2003

(87) PCT Pub. No.: WO02/11231

PCT Pub. Date: Feb. 7, 2002

(65) Prior Publication Data

US 2004/0051604 A1 Mar. 18, 2004

(30) Foreign Application Priority Data

Aug. 2, 2000 (DE) ..... 100 37 747

(51) Int. Cl.
*H01P 1/06* (2006.01)

(52) U.S. Cl. ..... 333/257; 333/261

(58) Field of Classification Search ..... 333/256, 333/257, 261
See application file for complete search history.

(56) References Cited

U.S. PATENT DOCUMENTS

| | | | | |
|---|---|---|---|---|
| 2,332,529 | A | | 10/1943 | Reppert |
| 2,678,835 | A | * | 5/1954 | Clark, Jr. |
| 2,763,844 | A | * | 9/1956 | Kruger ..... 333/257 |
| 5,781,087 | A | | 7/1998 | Milroy et al. |
| 6,018,279 | A | | 1/2000 | Arthur |

FOREIGN PATENT DOCUMENTS

| | | |
|---|---|---|
| GB | 2085662 | 4/1982 |
| GB | 2328086 | 2/1999 |

* cited by examiner

*Primary Examiner*—Benny Lee
(74) *Attorney, Agent, or Firm*—Kevin L. Daffer; Daffer McDaniel, LLP

(57) ABSTRACT

An array transmits a wide-band electric signal between at least two components disposed for rotation relative to each other. The components are provided with coupling surfaces that are maintained at a largely constant distance from each other via the rotary movement. The space between the coupling surfaces is predominantly filled with a dielectric material.

16 Claims, 5 Drawing Sheets

DEVICE FOR CARRYING OUT THE NON-CONTACT ROTATIONAL TRANSMISSION OF HIGH-FREQUENCY SIGNALS

The present invention relates to a device for rotary transmission of high-frequency signals, particularly high-frequency signals, between components disposed for rotation relative to each other.

To this end, a number of different transmission systems are known. Mechanically contacting slip rings display an appropriate transmission characteristic from zero frequency up into the 100 MHz range as long as the outside dimensions are small, compared against the shortest wavelengths to be transmitted. As a matter of fact, however, these mechanical sliding contact arrays present serious disadvantages such as a very wide-band contact noise or require high maintenance and—compared against non-contacting system—a comparatively short service life. Transmission of signals whose wavelength is in the order of magnitude of the diameter of the rotary transmitter is not possible according to the present state of the art.

For the transmission of high-frequency signals upwards to many GHz, rotary transmitters in the form of coaxial systems or hollow-core conductor systems are employed. The disadvantage of the coaxial systems resides in the aspect that these systems are mostly configured in the form of a coaxial plug and therefore require mechanically sliding contacts exhibiting a low reliability and a short service life.

The hollow-core conductor systems use $\lambda/4$ transformer for bridging the rotary gap, the boundary line between the two components rotating relative to each other, the transformer having a limited bandwidth. Such a rotary transmitter based on hollow-core conductors can only be realized with a comparatively limited bandwidth. Another disadvantage resides in the additional mechanical expenditure and also in the space required for the $\lambda/4$ transformers.

A substantial improvement of the reliability and the bandwidth can be achieved with the employment of active non-contacting rotary transmission systems. Such an active non-contacting rotary transmission system is described in DE 44 12958.0 for capacitive rotary transmission using strip-type transmission line technology. There, a signal is coupled by an amplifier into a strip line. The signals are coupled by a capacitive probe and a further amplifier. The disadvantage of this array is the comparatively small coupling capacity between the strip line and the coupling element, which, due to mechanical tolerances, vary strongly during the movement. For this reason, the amplifiers are required for impedance matching or amplification, respectively. Such arrays are primarily designed for the transmission of digital signals to minimize the effects of amplitude variations that are induced by a strongly varying coupling factor of the transmission system. Such active non-contacting transmission systems are hardly suitable for the transmission of analog signals.

SUMMARY OF THE INVENTION

The present invention is therefore based on the problem of providing an array which permits a wide-band transmission of electric signals at a low degree of maintenance.

The inventive array employs two components supported for rotation relative to each other, wherein each of these components comprises at least one coupling surface for capacitive signal coupling or decoupling. The coupling surfaces of the components are so arranged that they extend largely in parallel with each other at a slight distance of a few millimeters at maximum. Experience has shown that the optimum distance ranges on the order of 0.1 mm. Parallelism is to be understood in this context to denote an extension of the surfaces in a sense that they present a maximum capacity relative to each other. In the event of disintegration in the first coupling surface into infinitesimally small area segments, a respective infinitesimally small area segment corresponding thereto is provided on the second coupling surface, whose area extends at least largely in parallel with the first area segment. Hence, "parallelism" encompasses not only parallel plates but also concentric cylinders as well as other shapes, for instance conical surfaces disposed in superposition. Moreover, for increasing the coupling capacity and hence for reducing the coupling impedance, the space between the coupling surfaces is filled with a dielectric material to the greatest extent possible. Such a dielectric material may be a solid material, a liquid or a gas, for example. In order to achieve coupling independent of the position to a maximum extent, the coupling surfaces are guided relative to each other. This guiding function may be realized, for example, by an additional bearing or also by the arrangement of the coupling surfaces or the dielectric material, as such, respectively. Hence, the inventive device corresponds to a sliding contact bearing that is used for the transmission of high frequency signals.

A further inventive embodiment in the case of a circular dielectric consists in an array of the kind that is also known by the term "air bearing". Here, a particularly small gap exists between the two parts rotatable relative to each other, where the gap is supplied with a pressurized gas. The two areas slide on the gas almost without friction. In this array, the capacitive coupling is particularly good due to the relatively narrow gap and the high coupling capacity linked up therewith.

Another expedient embodiment in the case of liquids as dielectric material consists in providing a small gap between the rotating components, wherein this gap is filled with a liquid, preferably oil. This embodiment provides a very low-friction array that has also good bearing characteristics and, at the same time, ensures very good coupling characteristics due to the oil.

In a particularly advantageous embodiment of the invention, the rotatable components are so joined that they constitute a waveguide. In such a case it is also possible to reduce the dimensions of an existing $\lambda/4$ transformer by the application of a dielectric material in order to improve the transmission characteristics.

In a still further expedient embodiment of the present invention, the rotatable components are so combined that they constitute a coaxial conductor system.

According to yet another expedient embodiment of the invention, the dielectric material assumes also the mechanical guiding function in addition to the function of electric coupling. To this end, a dielectric material with particularly sound sliding characteristics on the electric coupling surface is selected.

A further advantageous embodiment of the invention provides for an arrangement of the coupling surfaces in rotational symmetry relative to the axis of rotation of the array. This permits a particularly simple structure. In particular, here commercially available components maybe used for sliding contact bearings.

According to other embodiments, the coupling surfaces are disposed in a radial or axial arrangement. As a consequence, the transmission system can be adapted to the respective system requirements. This applies also for an axial arrangement in which circular areas or circular ring areas, for instance, may be disposed in opposition to each other. Conical arrangements in the form of circle segments or semi-spheres are also contemplated.

Arrangements that are not exclusively oriented in an axial or radial direction may also receive forces along several axes, in addition to the transmission of electric signals. This permits the achievement of highly compact arrangements with an integrated support because electric and mechanical functions are combined in a single element.

In another embodiment of the invention, several coupling devices consist of the described coupling surfaces and dielectric media in a direction coaxial with the axis of rotation. When several coupling means are combined to form a single unit, it is possible, for example, to simulate coaxial conductor systems or to transmit also several signals at the same time.

According to a particularly expedient embodiment, the dielectric material comprises a material displaying good sliding characteristics or it consists completely of such a material. Hence, wear and heat formation are expediently reduced or prevented, respectively. Example of such a material are polytetrafluoroethylene (PTFE) such as Teflon® or Fluon®.

A further advantageous embodiment of the invention provides for a fixed connection of the dielectric material with one of the contact surfaces. As a result, the dielectric material is associated with a contact surface. In the case of liquids used as dielectric media, sliding ring seals in particular are of interest, which are machined with very high precision and which are suitable also for rotary transmission.

In another expedient embodiment, the dielectric material is impregnated with a small proportion of a lubricant for reduction of the friction between the mating contact elements.

A particularly advantageous embodiment of the invention involves the dielectric material being applied as a thin layer by electroplating on the surface of one of the mating contact elements. Hence, the dielectric material is disposed in a particularly stable and homogeneous manner on the surface.

Another expedient embodiment of the invention has the dielectric material being a thin ceramic layer that is applied to one of the surfaces of the mating contact elements. Ceramic materials present particularly appropriate mechanical characteristics, particularly a high thermal resistance. A specifically well-known design of such rotatable units coated with ceramic or even galvanic layers are referred to, for instance, as sliding-ring seals. Such sliding-ring seals are preferably employed for sealing rotary transmission systems for liquids and may also be used to transmit electric signals. Due to the slight distances between the two components supported for rotation relative to each other, these sliding-ring seals present a particularly high coupling capacity and are hence excellently suitable for transmitting high-frequency signals.

In another expedient embodiment of the invention, the dielectric material consists of a thin layer of a liquid or a gas. The high rigidity of thin liquid or gas layers serves maintain a minimum spacing between the two components supported for rotation relative to each other.

According to another embodiment of the invention, the coupling surfaces include structures for multi-channel signal transmission. As a result, for example, the transmission rates or the data volumes transmitted may be increased.

The provision of coupling surfaces with structures for multi-channel signal transmission may be realized, for example, by printed circuit boards including coaxial structures. In this manner, a comparatively simple structure is possible.

In an inventive method, plain bearings are used for transmitting high-frequency signals between two units rotatable relative to each other. Due to the comparatively large areas of the bearing surfaces running on each other, a high coupling capacity is achieved. This capacity is additionally increased by a dielectric material that is mostly present and that is used as intermediate layer or lubricant, respectively, for reducing the friction. The materials used normally as friction-reducing intermediate layer, such as Teflon®, are moreover characterized by extremely low high-frequency losses.

BRIEF DESCRIPTION OF THE DRAWINGS

These and other objects, features and advantages of the present invention will become more readily apparent from the following detailed description of currently preferred configurations thereof when taken in conjunction with the accompanying drawings wherein.

DETAILED DESCRIPTION OF THE DRAWINGS

Figure 1:
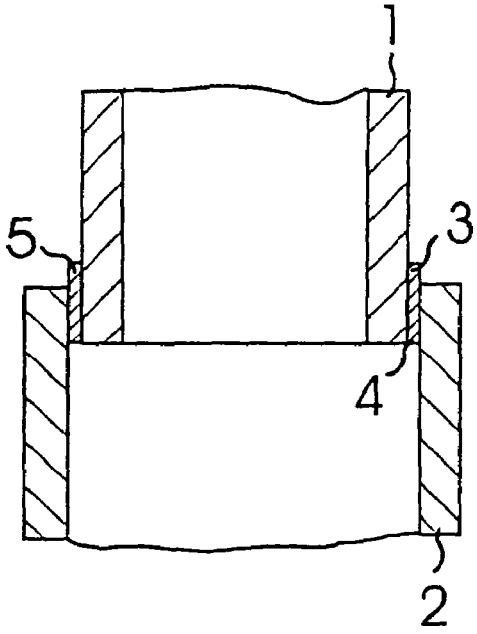
FIG. 1 is a partial, cross-sectional schematic view of a coaxial array in accordance with the present invention.

FIG. 1 illustrates an exemplary embodiment of an inventive array embodied in a coaxial configuration. There, the first component 1, which is supported for rotation relative to the second component 2, comprises at least a first contact surface 3 that corresponds to a second contact surface 4 of the second component. A dielectric material 5 is provided between the two components.

Figure 2:
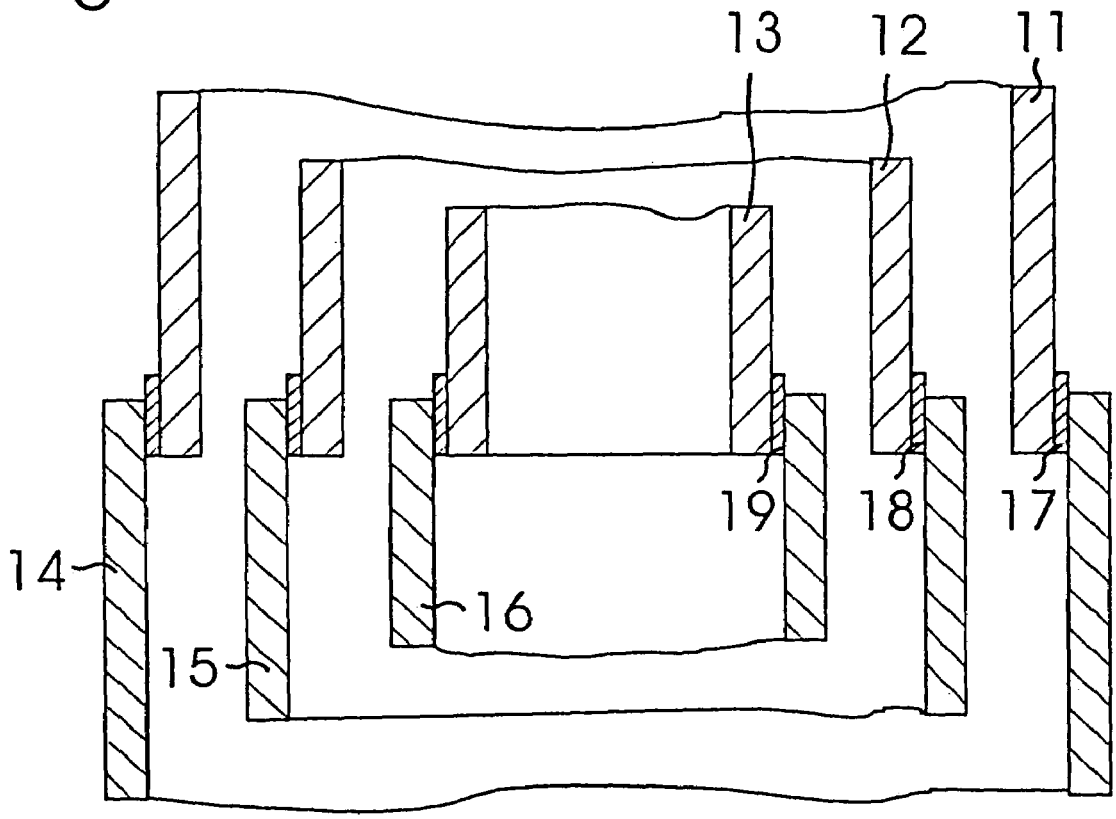
FIG. 2 is a partial, cross-sectional view of a multi-channel arrangement in accordance with the present invention.

FIG. 2 is an exemplary view of another inventive array that is suitable for simultaneously transmitting several signals. The contact surfaces 11, 12, 13 are formed on the first rotating component and the corresponding contact surfaces 14, 15, 16 are formed on the second rotating component. The contact surfaces are coupled by dielectric layers 17, 18, 19.

Figure 3:
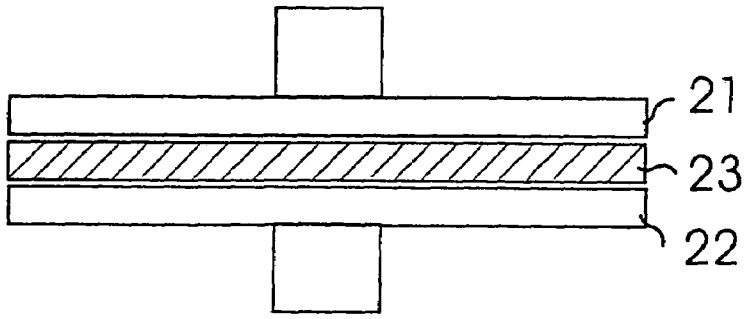
FIG. 3 is a cross-sectional view of an arrangement with a dielectric material in a direction orthogonal on the axis of rotation.

FIG. 3 illustrates another exemplary arrangement according to the invention, in which the dielectric material 23 is disposed, for example, in a direction orthogonal on the axis of rotation. Here, the signals are coupled from the first rotatable surface 21 by the dielectric material 23 to the second surface 22.

Figure 4:
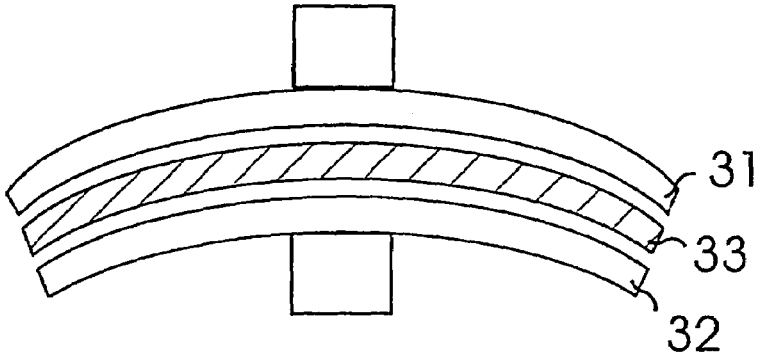
FIG. 4 is a partial, cross-sectional view of an array including a semi-spherical dielectric material.

FIG. 4 shows a further exemplary array according to the invention, in which, for instance, the dielectric material 33 or the coupling surfaces 31, 32, respectively, present a semi-spherical configuration. Here, any other configurations such as ellipsoids are contemplated options.

Figure 5:
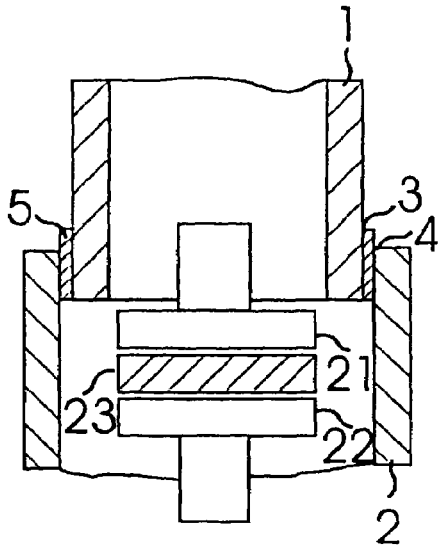
FIG. 5 is a partial, cross-sectional view of a multi-channel array in accordance with the present invention.

FIG. 5 is a view of another inventive arrangement for multi-channel transmission, in which a dielectric material for coupling a channel in parallel with the axis of rotation and another dielectric material for coupling the second channel are disposed in a direction orthogonal on the axis of rotation. This corresponds to a combination of FIGS. 1 and 3. Here, the same reference numerals are assigned to the same elements.

Figure 6:
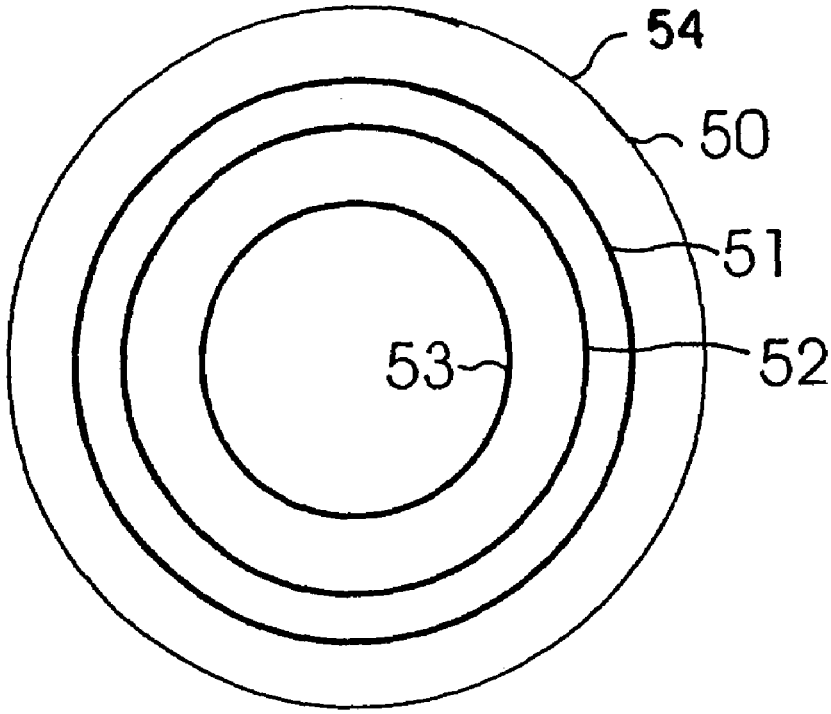
FIG. 6 is a view of an array with coaxial conductor structures in accordance with the present invention.

FIG. 6 shows an arrangement in which a coupling surface 50 comprises coaxial conductor structures 51, 52, 53 that are expediently disposed on a printed circuit board 54.

Figure 7:
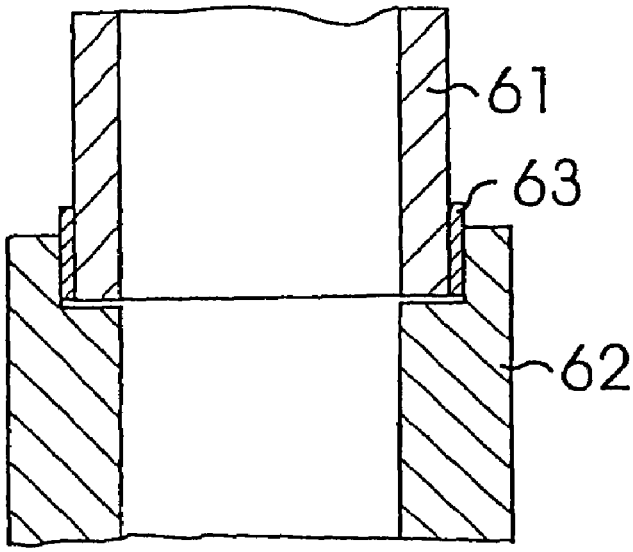
FIG. 7 is a partial, cross-sectional view of a hollow-core conductor structure in accordance with the present invention.

FIG. 7 is a view of a hollow-core conductor array consisting of the two rotatable components 61, 62 and the dielectric material 63.

Figure 8:
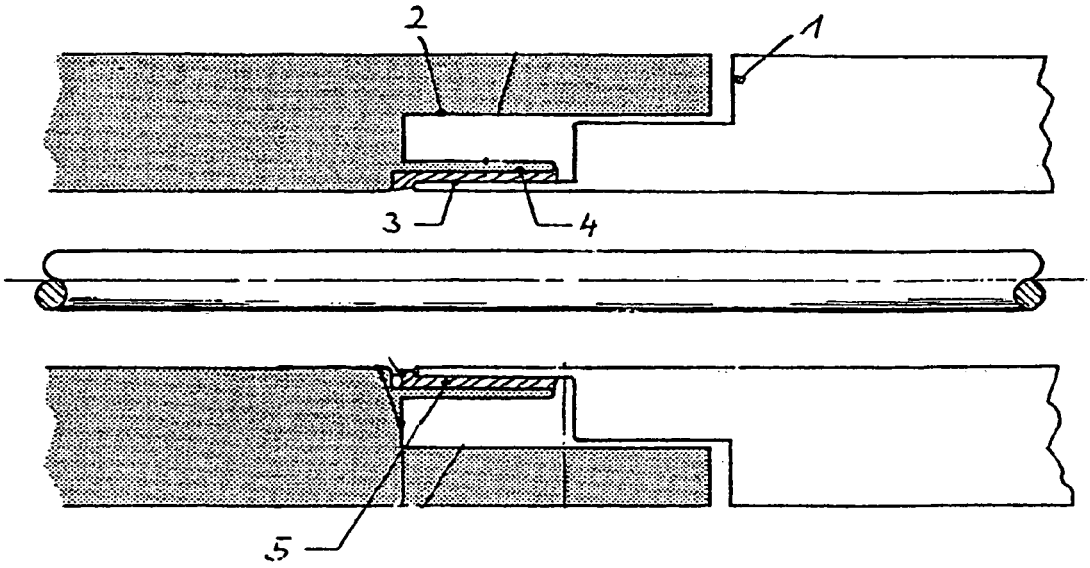
FIG. 8 is a partial, cross-sectional view showing details of a coaxial rotary connection.

FIG. 8 shows a coaxial rotary connection. Here, the first component 1, which is supported for rotation relative to the second component 2, comprises at least one first contact surface 3 that corresponds with a second contact surface 4 of the second component. A dielectric material 5 is disposed between the two components for low-resistance coupling of the two components.

Figure 9:
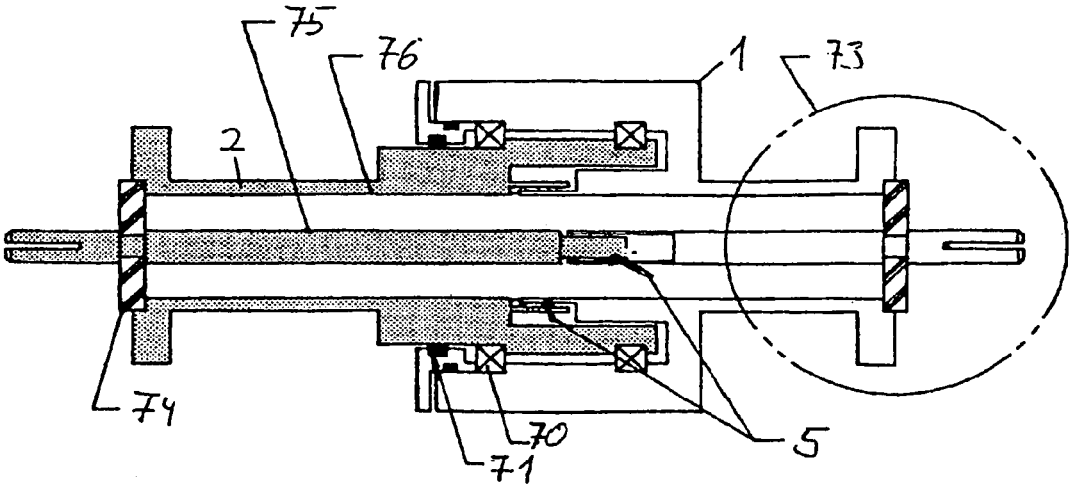
FIG. 9 is a view of an industrial implementation of a coaxial rotary connection in accordance with the present invention.

FIG. 9 illustrates a coaxial rotary connection including an internal conductor 75 and an external conductor 76. The internal conductor is positioned relative to the external conductor by way of dielectric supports 74. The first component 1 is supported for rotation relative to the second component 2 by the bearings 70 and their seal 71. A dielectric material 5 is provided between the two components. The contact of the rotary connection is implemented by means of the coaxial plugs 73 shown in the dot-dash circle.

Figure 10:
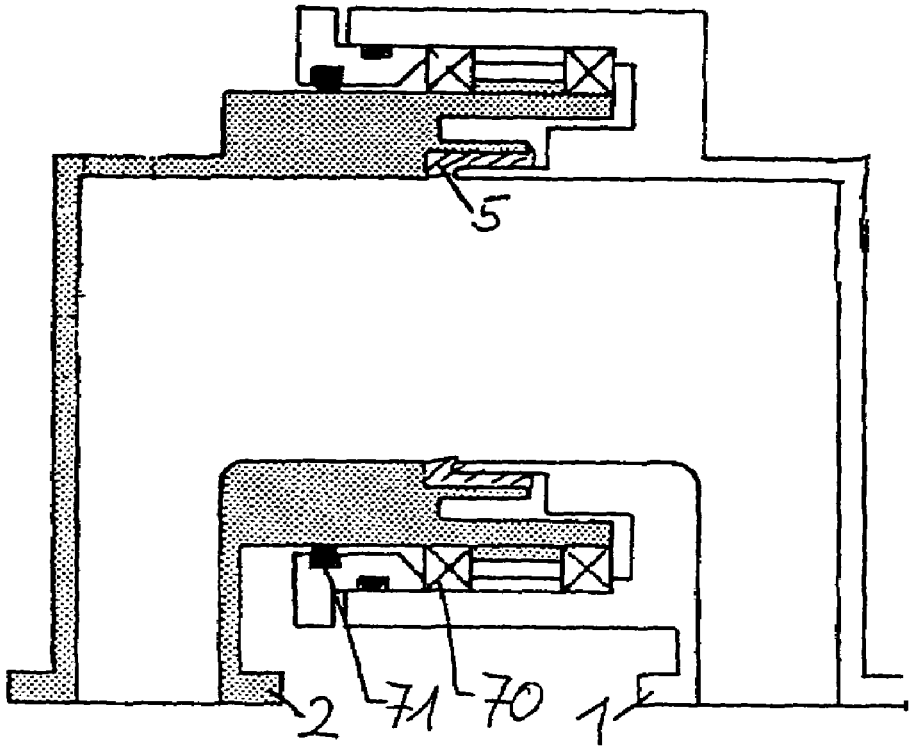
FIG. 10 is a view of a technological implementation of a hollow-core conductor rotary connection.

FIG. 10 shows a rotary connection including hollow-core conductors. The first component 1 is supported for rotation relative to the second component 2 by the bearings 70 and their sealing arrangements 71. A dielectric material 5 is disposed between the two components.

The invention claimed is:

1. Array for wide-band electric signal transmission between at least two components disposed for movement relative to each other, said at least two components having coupling surfaces providing a sliding contact bearing and being maintained at a substantially constant distance from each other via the movement, wherein the space between said coupling surfaces is substantially filled with a dielectric material, being substantially gas, wherein said components are provided with coupling surfaces that are an air bearing maintained at a very small distance by the gas.

2. Array for wide-band electric signal transmission between at least two components disposed for movement relative to each other, said at least two components having coupling surfaces providing a sliding contact bearing and being maintained at a substantially constant distance from each other via the movement, wherein the space between said coupling surfaces is substantially filled with a dielectric material being substantially a liquid, wherein said at least two components are maintained at a very small distance by the liquid comprising an oil film.

3. Array for wide-band electric signal transmission between at least two components disposed for movement relative to each other, said at least two components having coupling surfaces providing a sliding contact bearing and being maintained at a substantially constant distance from each other via the movement, wherein the space between said coupling surfaces is substantially filled with a solid dielectric material fixed to only one of said coupling surfaces to provide capacitive coupling of an electrical signal transmission between the coupling surfaces.

4. Array according to claim 3, wherein the array is configured as a circular waveguide for transmission of electromagnetic waves.

5. Array according to claim 3, wherein the array is configured as a coaxial conductor system for transmission of electromagnetic waves.

6. Array according to claim 3, wherein said dielectric material is configured to serve for electric coupling and simultaneously as a mechanical guide for said coupling surfaces supported for movement relative to each other.

7. Array according to claim 3, wherein said relative movement of said at least two components is rotational, and said coupling surfaces are symmetrically mounted relative to an axis of rotation of the array.

8. Array according to claim 7, wherein said coupling surfaces are disposed radially with respect to the axis of rotation.

9. Array according to claim 7, wherein said coupling surfaces are disposed axially with respect to the axis of rotation.

10. Array according to claim 3, wherein said coupling surfaces extend in at least one of radial and axial directions.

11. Array according to claim 3, wherein a plurality of transmission systems consisting of said coupling surfaces and said dielectric material form a single unit.

12. Array according to claim 3, wherein said dielectric material is a material having desired sliding characteristics.

13. Array according to claim 3, wherein said coupling surfaces are configured for multi-channel signal transmission.

14. Array according to claim 3, wherein said dielectric material is impregnated with a proportion of a lubricant sufficient for reducing mechanical friction.

15. Array for wide-band electric signal transmission between at least two components disposed for movement relative to each other, said two components having coupling surfaces providing a sliding contact bearing and being maintained at a substantially constant distance from each other via the movement, wherein the space between said coupling surfaces is substantially filled with a dielectric material comprising a thin ceramic layer applied on at least one of said coupling surfaces.

16. Array according to claim 15, wherein said dielectric material is a thin layer applied by electroplating on a surface of at least one coupling surface.

* * * * *

UNITED STATES PATENT AND TRADEMARK OFFICE

CERTIFICATE OF CORRECTION

PATENT NO. : 7,148,773 B2
APPLICATION NO. : 10/332081
DATED : December 12, 2006
INVENTOR(S) : Lohr It is certified that error appears in the above-identified patent and that said Letters Patent is hereby corrected as shown below:

Col. 6, line 55: Insert --of said at least two components-- after "coupling surfaces".

Signed and Sealed this

Eighth Day of May, 2007

JON W. DUDAS
*Director of the United States Patent and Trademark Office*